US009328914B2

(12) United States Patent
Ksobiech

(10) Patent No.: US 9,328,914 B2
(45) Date of Patent: May 3, 2016

(54) LIGHTED TOOTH FOR A VEGETABLE LANTERN AND KIT

(71) Applicant: Pumpkin Teeth LLC, Windsor, WI (US)

(72) Inventor: Keith E. Ksobiech, Windsor, WI (US)

( * ) Notice: Subject to any disclaimer, the term of this patent is extended or adjusted under 35 U.S.C. 154(b) by 304 days.

(21) Appl. No.: 14/158,412

(22) Filed: Jan. 17, 2014

(65) Prior Publication Data

US 2014/0198478 A1 Jul. 17, 2014

Related U.S. Application Data

(60) Provisional application No. 61/753,782, filed on Jan. 17, 2013.

(51) Int. Cl.

| | |
|---|---|
| ***F21V 33/00*** | (2006.01) |
| ***F21K 2/06*** | (2006.01) |
| ***A63H 33/22*** | (2006.01) |
| ***F21V 21/08*** | (2006.01) |
| *F21S 9/02* | (2006.01) |
| *F21W 121/00* | (2006.01) |
| *F21Y 101/02* | (2006.01) |

(52) U.S. Cl.

CPC ..... *F21V 33/008* (2013.01); *A63H 33/22* (2013.01); *F21K 2/06* (2013.01); *F21V 21/0824* (2013.01); *F21V 33/0028* (2013.01); *F21S 9/02* (2013.01); *F21W 2121/00* (2013.01); *F21Y 2101/02* (2013.01)

(58) Field of Classification Search

CPC ..... F21V 33/008; F21V 21/0824; F21V 33/0028; F21K 2/06

See application file for complete search history.

(56) References Cited

U.S. PATENT DOCUMENTS

| | | | | |
|---|---|---|---|---|
| 3,822,170 | A | 7/1974 | Smolen | |
| 5,091,833 | A | 2/1992 | Paniaguas et al. | |
| 5,162,138 | A | 11/1992 | Caflisch et al. | |
| 5,984,754 | A * | 11/1999 | Freelander | B44C 5/005 362/154 |
| 6,309,092 | B1 | 10/2001 | Bardeen et al. | |
| 6,575,613 | B2 | 6/2003 | Brown et al. | |
| 6,578,710 | B1 | 6/2003 | Brown et al. | |
| D481,651 | S | 11/2003 | Homesley | |
| 6,681,469 | B2 | 1/2004 | Damon | |
| 7,237,922 | B2 | 7/2007 | Cayton | |
| D568,779 | S | 5/2008 | Birkmann et al. | |
| D634,668 | S | 3/2011 | Ksobiech | |
| 8,220,964 | B1 | 7/2012 | Martin | |
| D678,121 | S | 3/2013 | Ksobiech | |
| D678,122 | S | 3/2013 | Ksobiech | |
| 9,022,595 | B1 * | 5/2015 | Schilling | F21V 33/0028 362/154 |
| 2005/0248952 | A1 | 11/2005 | Yao et al. | |
| 2007/0036920 | A1 | 2/2007 | Birkmann et al. | |
| 2011/0117812 | A1 | 5/2011 | Conner | |
| 2011/0261560 | A1 | 10/2011 | Muccianti | |

* cited by examiner

*Primary Examiner* — David V Bruce

(57) ABSTRACT

A self-illuminating tooth for a vegetable lantern is provided. The self-illuminating tooth has a tooth portion with a front facing portion, a rear facing portion, and a cavity provided within the tooth portion provided on the rear facing portion. A tooth retention portion is coupled to the tooth portion and has a plurality of flights, each flight having a serrated edge. A light is provided within the cavity of the tooth portion. The light in certain examples comprises a chemiluminescent tooth insert and is replaceable within the cavity. In other examples, a light and switch mechanism are provided. The light may be selectively actuated to illuminate the tooth portion. A method of decorating a vegetable lantern and a kit are also provided.

20 Claims, 20 Drawing Sheets

LIGHTED TOOTH FOR A VEGETABLE LANTERN AND KIT

CROSS-REFERENCE TO RELATED APPLICATIONS

This application claims the benefit of and priority to U.S. Provisional Patent Application Ser. No. 61/753,782 entitled "Decorative Self-Illuminated Tooth for a Vegetable Lantern and Decoration Kit having at least One Self-Illuminated Tooth for a Vegetable Lantern" filed Jan. 17, 2013, the entire contents of which is hereby incorporated by reference herein in its entirety.

FIELD

The present inventions relate to decorations for vegetable lanterns, such as for example pumpkins. More specifically, the present inventions relate to a self-illuminated tooth for use in a vegetable lantern, and a decoration kit having a self-illuminated tooth for use in a vegetable lantern.

BACKGROUND

Vegetable lanterns are generally known in the art. An example of a vegetable lantern includes, but is not limited to, a pumpkin or jack-o'-lantern. In addition to decorative lanterns being made from pumpkins, other vegetables are known to be made into decorative lanterns. These vegetables include, but are not limited to, turnips, mangel wurzel or mangel beet, and/or rutabaga or Swedish turnip, and the like.

Vegetable lanterns have been historically carved and decorated using a cutting device, such as a knife. In addition, historically the inside of the vegetable lantern is removed and a candle or open flame is placed therein, illuminating the carving or decoration on the lantern.

However, traditional methods of decorating and illuminating a vegetable lantern have certain limitations. For example, placing an open flame within the lantern can lead to safety and/or fire concerns. In addition, candles and/or other open flame sources typically are not reusable. Further, consumers today often use multiple tools to decorate the vegetable lantern.

Accordingly, what is needed is one or more reusable self-illuminating vegetable lantern decorations and a kit for the decoration of the vegetable lantern.

SUMMARY

Accordingly, a self-illuminating tooth for a vegetable lantern is disclosed. The self-illuminating tooth has a tooth portion with a front facing portion, a rear facing portion, and a cavity provided within the tooth portion provided on the rear facing portion. A tooth retention portion is coupled to the tooth portion and has a plurality of flights, each flight having a serrated edge. A light is provided within the cavity of the tooth portion. The light comprises a chemiluminescent tooth insert and is replaceable within the cavity. The light may be selectively actuated to illuminate the tooth portion by actuation of the light.

A self-illuminating tooth for a vegetable lantern is also disclosed including a tooth portion having a front facing portion, a rear facing portion, and a cavity provided within the tooth portion provided on the rear facing portion, as well as a tooth retention portion coupled to the tooth portion and having a plurality of flights, each flight having a serrated edge. A light assembly is provided within the cavity of the tooth portion and has a light, a power source, and a switch assembly, wherein the light assembly may be selectively actuated to illuminate the tooth portion by actuation of the switch assembly.

A method of decorating a pumpkin is disclosed. The method includes the steps of inserting a tooth retention portion of a self-illuminating tooth into an outer membrane of a pumpkin, and activating a light source for the self-illuminating tooth such that a light within the self-illuminating tooth illuminates the tooth.

The present invention provides one or more examples of embodiments of a self-illuminating vegetable lantern decoration. The decoration is illustrated as one or more teeth used for decorating a vegetable lantern. The self-illuminating vegetable lantern decorations may be provided individually, in a set of teeth suitable to decorate the mouth of a face provided on a vegetable lantern, or in a decorating kit having the necessary elements to suitably decorate a vegetable lantern.

These and other features and advantages of devices, systems, and methods according to this invention are described in, or are apparent from, the following detailed descriptions of various examples of embodiments.

BRIEF DESCRIPTION OF DRAWINGS

Various examples of embodiments of the systems, devices, and methods according to this invention will be described in detail, with reference to the following figures, wherein.

Figure 1:
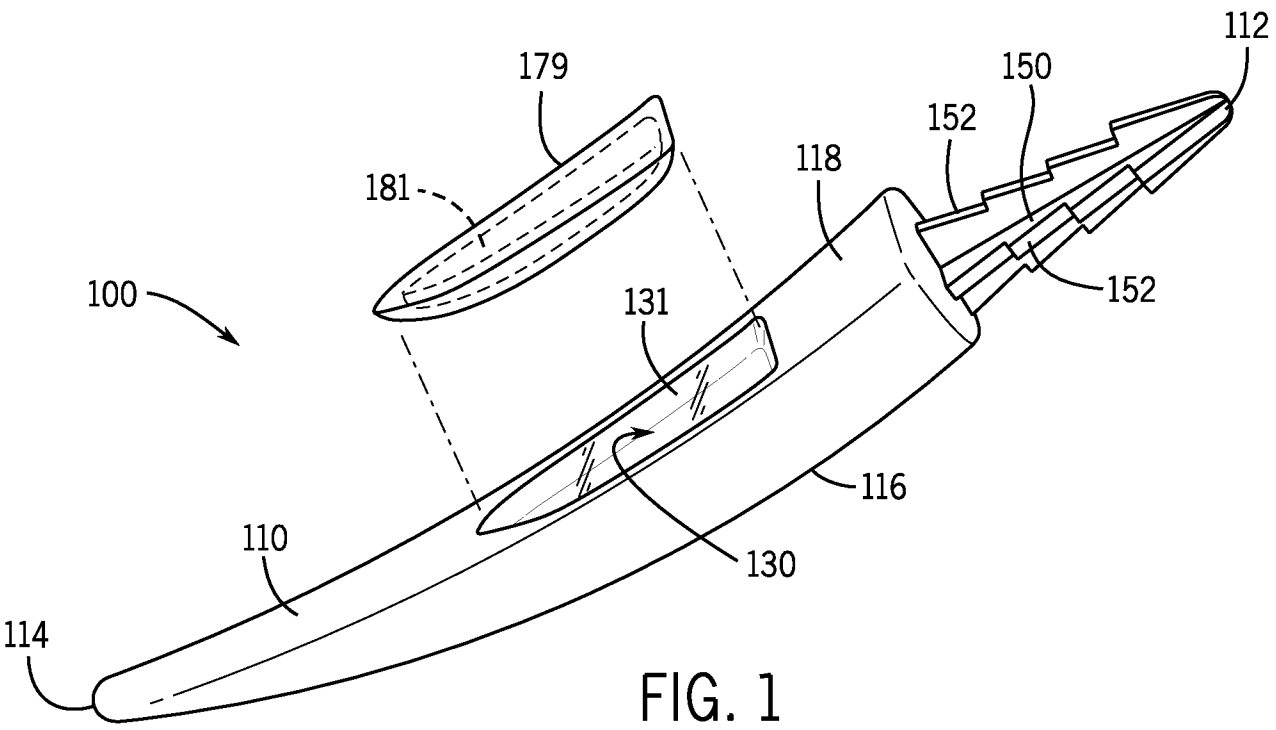
FIG. 1 is an isometric view of one or more examples of an embodiment of a self-illuminating tooth for a vegetable lantern, showing a chemiluminescent light source separated from the tooth.

It should be understood that the drawings are not necessarily to scale. In certain instances, details that are not necessary to the understanding of the invention or render other details difficult to perceive may have been omitted. It should be understood, of course, that the invention is not necessarily limited to the particular embodiments illustrated herein.

DETAILED DESCRIPTION

The invention illustrated in the Figures and disclosed herein is generally directed to one or more embodiments of a self-illuminated tooth for use in a vegetable lantern and a kit associated therewith. For ease of discussion and understanding, the following detailed description will at times refer to a "pumpkin." It should be appreciated that the term "pumpkin" is used for purposes of example alone. While a "pumpkin" is commonly decorated into a decorative lantern in association with the United States holiday Halloween, the self-illuminated tooth disclosed herein may also be used in association with any suitable vegetable which may be formed into a decorative lantern, a jack-o'-lantern, and/or any suitable decorative lantern, including, but not limited to, any other material or substance which may be used or formed as a decorative lantern, for example a plastic, foam, or other suitable material formed to look like a jack-o'-lantern or decorative lantern.

A pumpkin tooth 100 or pumpkin teeth as described herein may take a variety of forms. Referring generally to the Figures, in one or more examples of embodiments, the pumpkin tooth 100 or teeth have a tooth portion 110 or area in the shape of a tooth, for example a fang, and an insertion element or retention portion 150 which is adapted for insertion and/or retention of the pumpkin tooth into the pumpkin. The pumpkin tooth 100 or teeth, and in particular the tooth portion 110, may be provided in a variety of shapes and forms to provide different appearances. Examples include, but are not limited to, fangs, buck teeth, blood fangs, glow-in-the dark teeth or fangs. The tooth 100 or teeth may be provided in varying widths, lengths, and/or diameters. The insertion element or retention portion 150 has, in one or more examples of embodiments, ribs or barbs which extend from an outer surface of the insertion element. The insertion element is designed such that it may be easily pressed into or inserted into a pumpkin or other material, and retained in place via the resistance caused by the barbs or ribs against the material. While specific examples are provided variations thereon would not depart from the overall scope of the present invention.

FIGS. 1-14 illustrate one or more examples of embodiments of a self-illuminated tooth 100 for use in a vegetable lantern. More specifically, the Figures illustrate one or more examples of an embodiment of a lighted tooth 100 for use in a pumpkin.

Tooth 100 includes a tooth portion 110 and a tooth retention portion 150. Referring to FIGS. 1-5, tooth portion 110 may include a first end 112 and a second end 114. Tooth portion 110 includes a front or outward facing portion 116 and a back or rear facing portion 118. As illustrated, tooth portion 110 is disclosed as a fang or an elongated tooth having an arcuate or curved shape. It should be appreciated in one or more examples of embodiments that the tooth portion may be any suitable, desired, or combination of tooth shapes, including, but not limited to, molars, incisors, canine, buck teeth, broken teeth, or any other desired tooth or combination of teeth.

Retention portion 150 is provided on the first end 112 of tooth portion 110. Retention portion 150 includes a plurality of flights 152. As illustrated, for example in FIG. 7, the four flights 152 are provided in a cross shaped cross-sectional arrangement when viewed from the first end 112 of tooth portion 110, although variations thereon may be acceptable. Each flight 152 may include a plurality of serrations or serrated edges or barbs 154 to facilitate retention of retention portion 150 in a pumpkin. In one or more examples of embodiments, greater than or fewer than four flights may be provided on the retention portion. In addition, in one or more examples of embodiments, the flights may be provided in any suitable cross-sectional arrangement, including, but not limited to, a circular, rectangular, or other suitable polygonal or non-polygonal arrangement.

Figure 2:
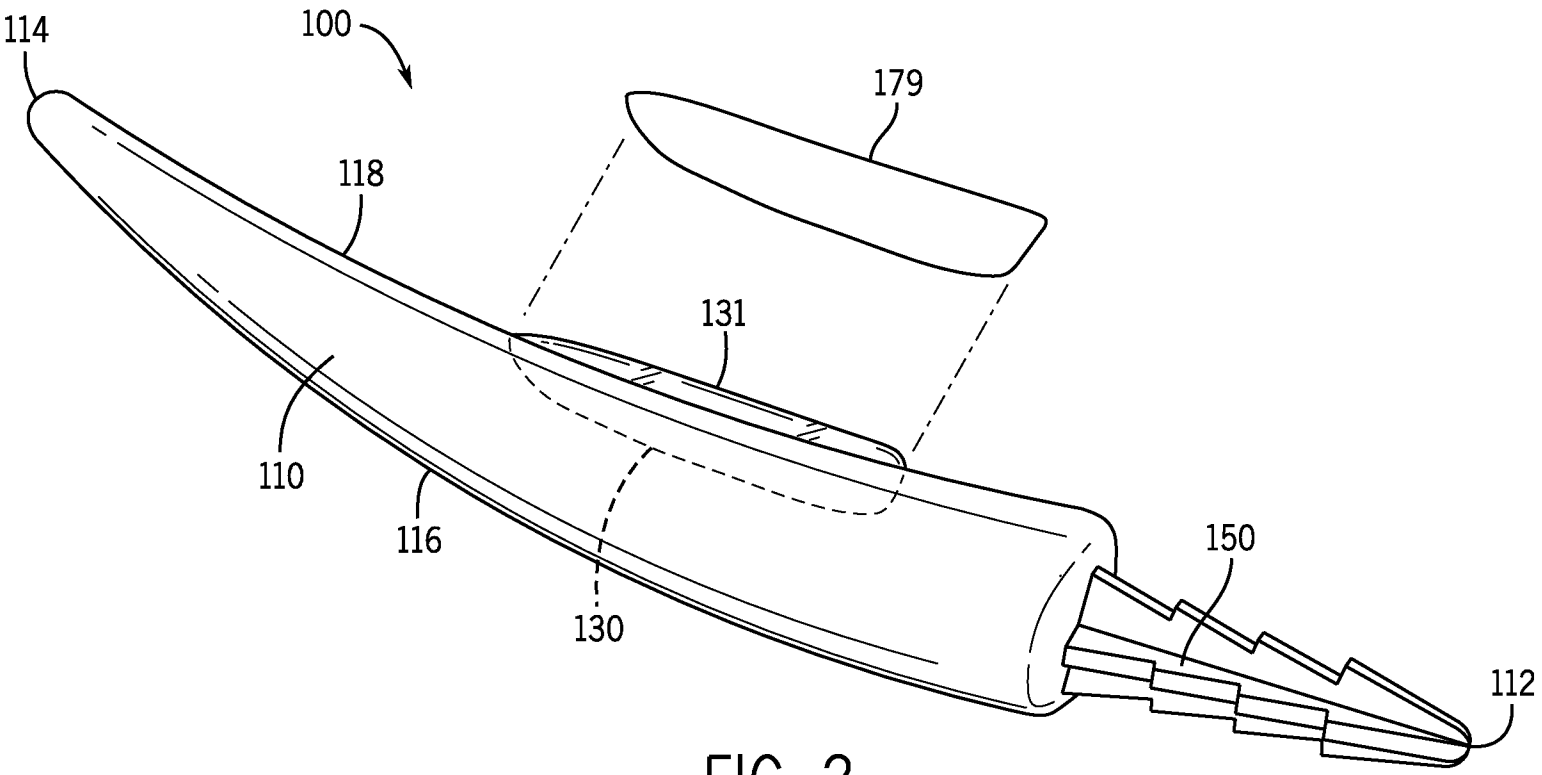
FIG. 2 is a side elevation view of a self-illuminating tooth of the type shown in FIG. 1.
Figure 5:
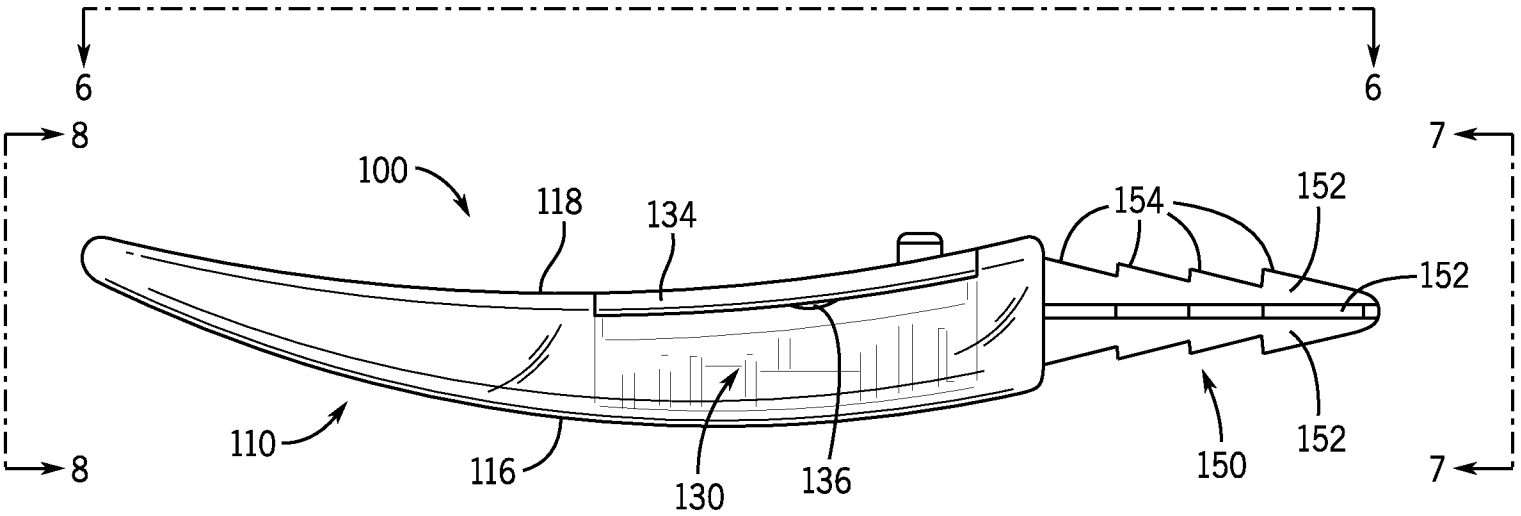
FIG. 5 is a side elevation view of the self-illuminating tooth of FIG. 4, illustrating a portion of the tooth as semi-transparent to show a portion of an internal cavity provided therein.
Figure 6:
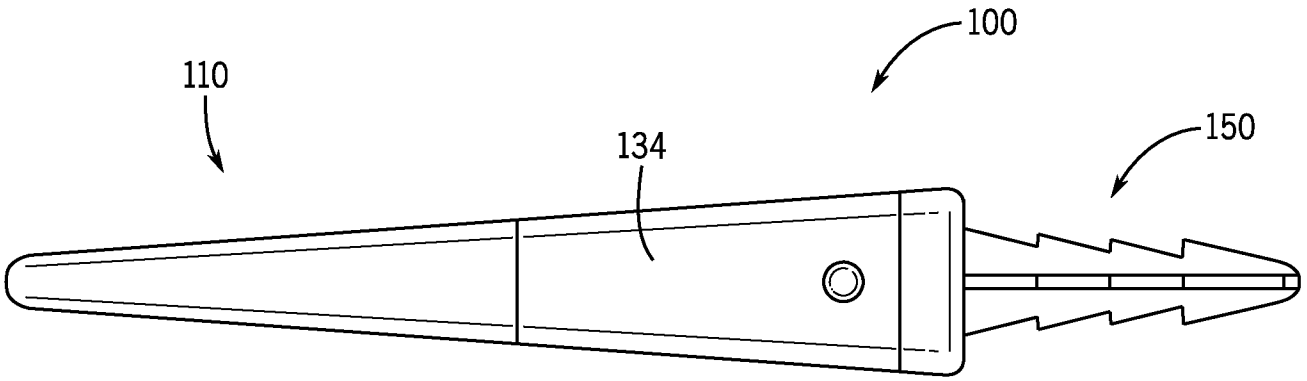
FIG. 6 is a top down plan view of the self-illuminating tooth of FIG. 4, taken along line 6-6 of FIG. 5.
Figure 8:
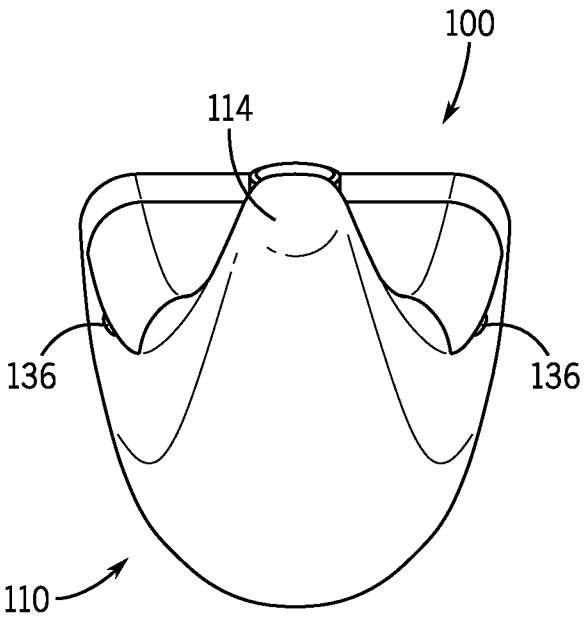
FIG. 8 is a second end elevation view of the self-illuminating tooth of FIG. 4, taken along line 8-8 of FIG. 5.
Figure 7:
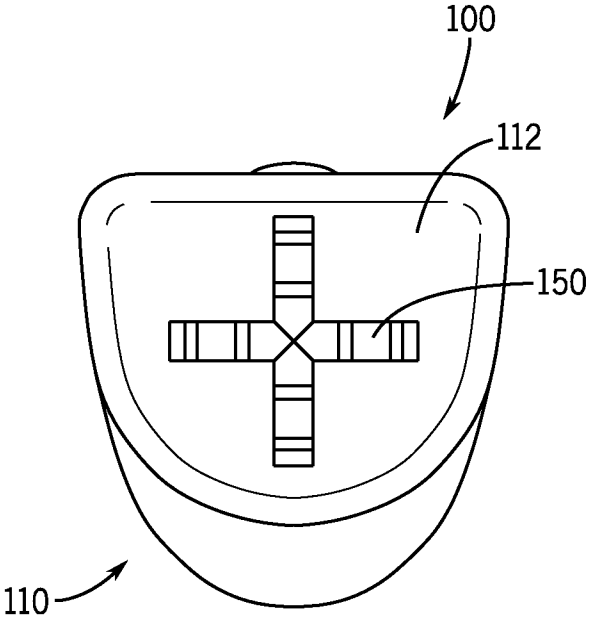
FIG. 7 is a first end elevation view of the self-illuminating tooth of FIG. 4, taken along line 7-7 of FIG. 5.
Figure 9:
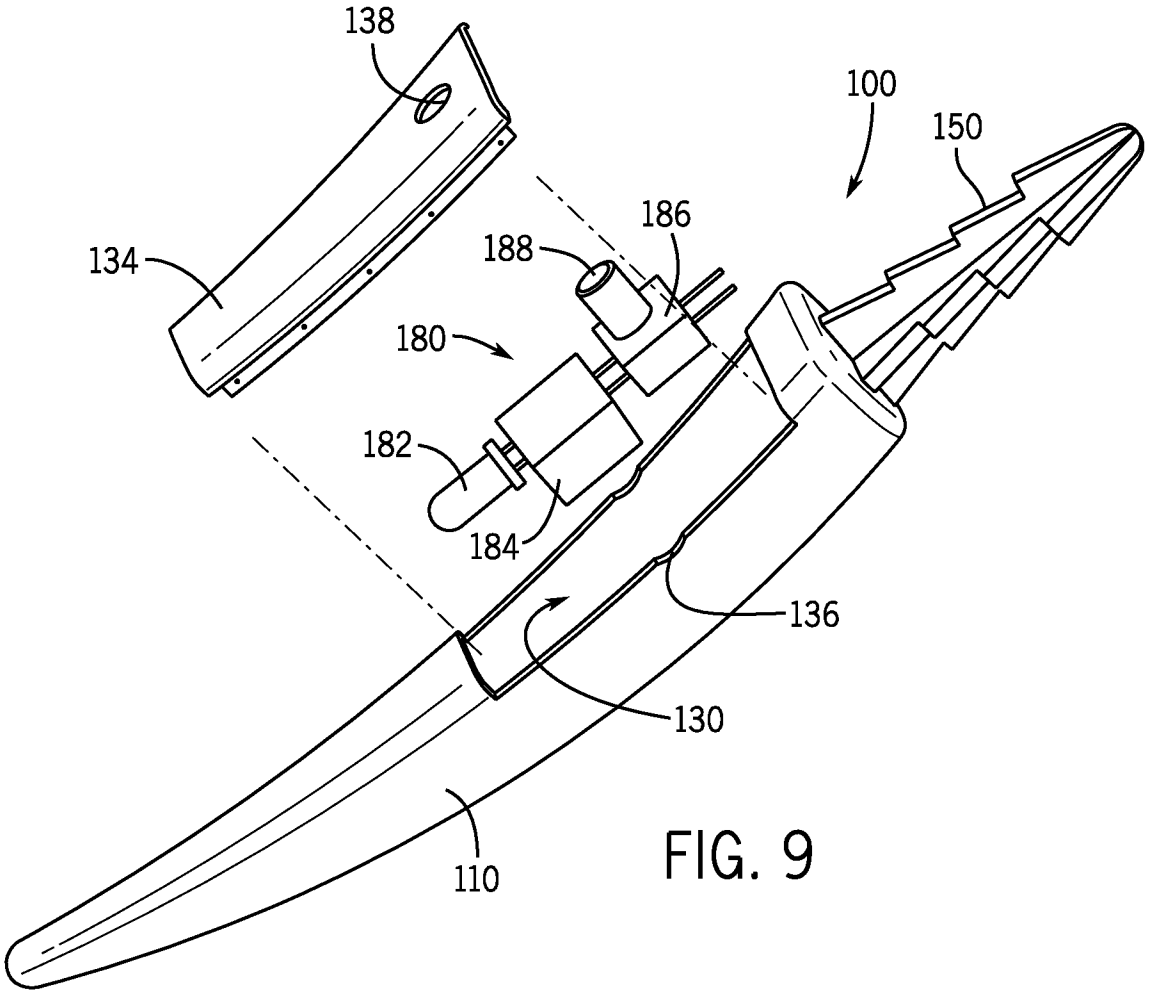
FIG. 9 is an exploded view of the self-illuminating tooth of FIG. 4.
Figure 10:
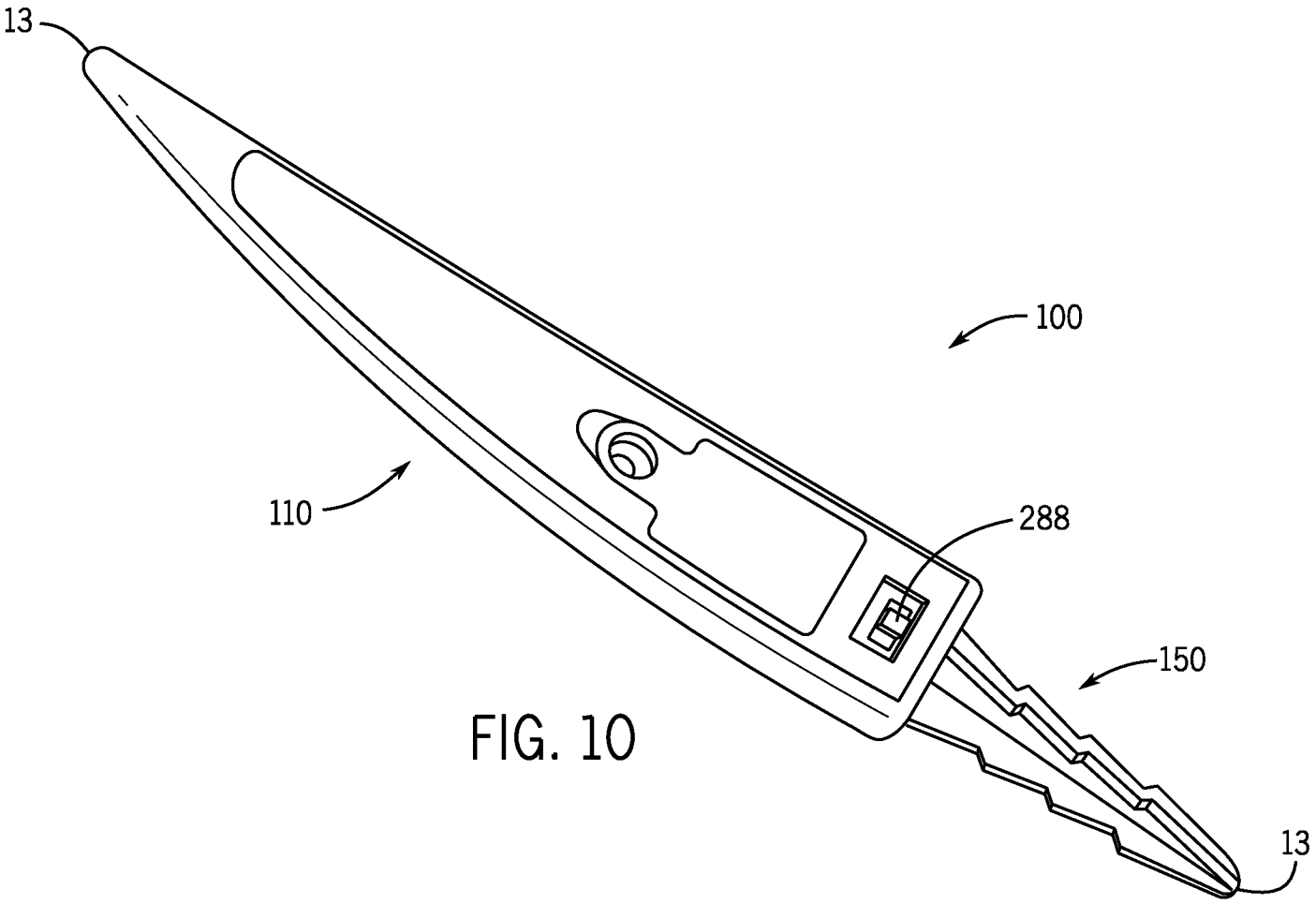
FIG. 10 is an isometric view of one or more alternative examples of embodiments of a self-illuminating tooth for a vegetable lantern.
Figure 11:
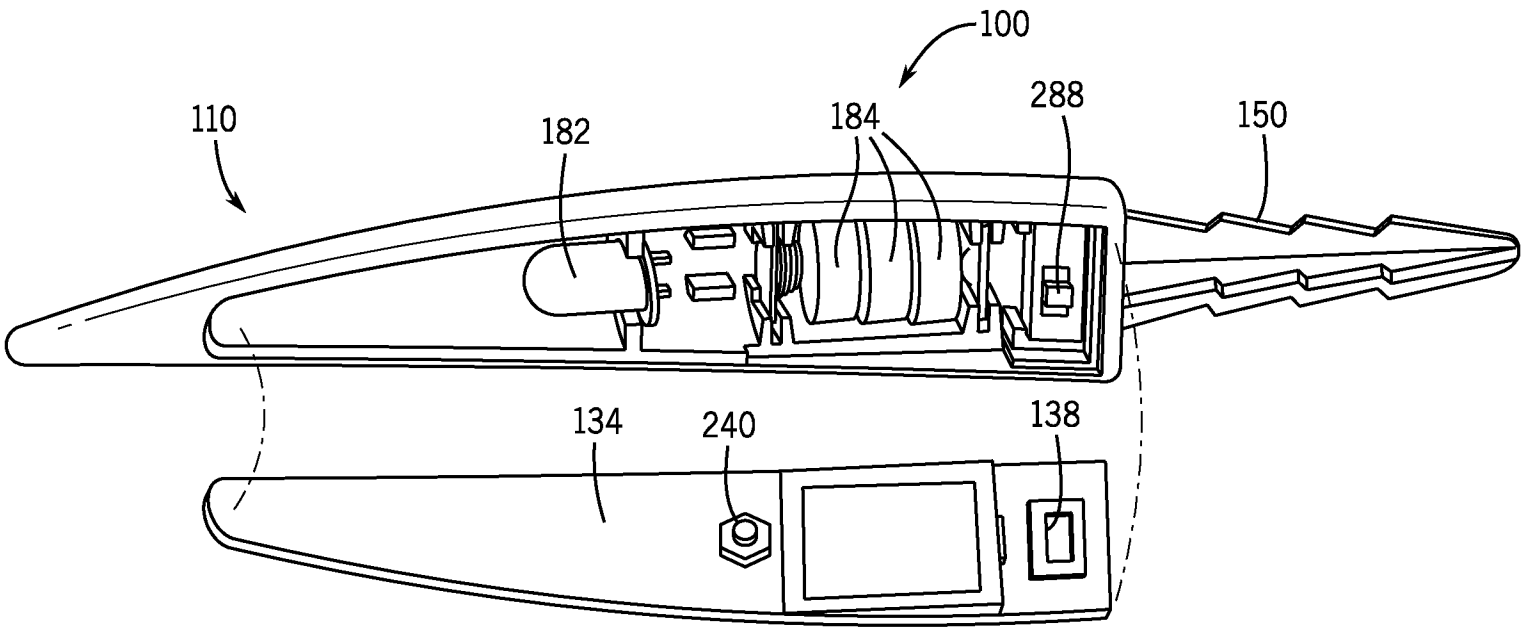
FIG. 11 is a partially exploded view of the self-illuminating tooth of FIG. 10, illustrating an illuminated light.

As illustrated in FIGS. 1, 5, and 9, tooth portion 110 includes a cavity 130 formed by or including an access passage into the tooth. Cavity 130 is an open area provided within a portion of tooth portion 110. Cavity may be provided in any suitable location on the tooth 100. In the illustrated embodiments, cavity 130 is positioned on back surface 118. Cavity 130 is of a suitable size to removably receive and internally house a light source or light illuminating assembly or light assembly (e.g., 179, 180, 182) within tooth portion 110. In one or more examples of embodiments, such as illustrated in FIGS. 1-2, the cavity 130 is sized to fit a correspondingly sized light source 179. To this end, the light source 179 may be press-fit and removably received within the cavity 179 of the tooth. Accordingly, the insert 179 may be retained in the cavity 130 by suitable means, such as a friction fit or a retention mechanism. The cavity 130 may be initially covered so as to provide an enclosure. In this regard, a breakable seal, such as for example, a blister-seal covering 131 (FIGS. 1-2) may be provided. The breakable seal or blister-seal covering 131 is preferably formed of a material which is breakable or malleable such that the light source can be pressed into the cavity 130, e.g., through the seal or in movement with the seal. The blister-seal 131 may extend above the back surface 118 of the tooth portion 110 (see FIG. 2) or may be flush with said surface (see FIG. 1). While the blister-seal 131 is illustrated on the back surface, it is further contemplated that the blister-seal may be provided on any surface of the tooth 100 suitable for the purposes provided and providing access to a cavity 130 of the tooth. In the illustrated example, a single cavity 130 and blister-seal are shown. However, it is understood that more than one cavity and blister-seal for access to the cavity may be provided in association with one or more light sources. In one or more alternative embodiments, a removable cap or lid 134 is provided. The removable cap or lid 134 is discussed in further detail herein below. The cavity 130 may also remain open in one or more examples of embodiments.

Figure 3:
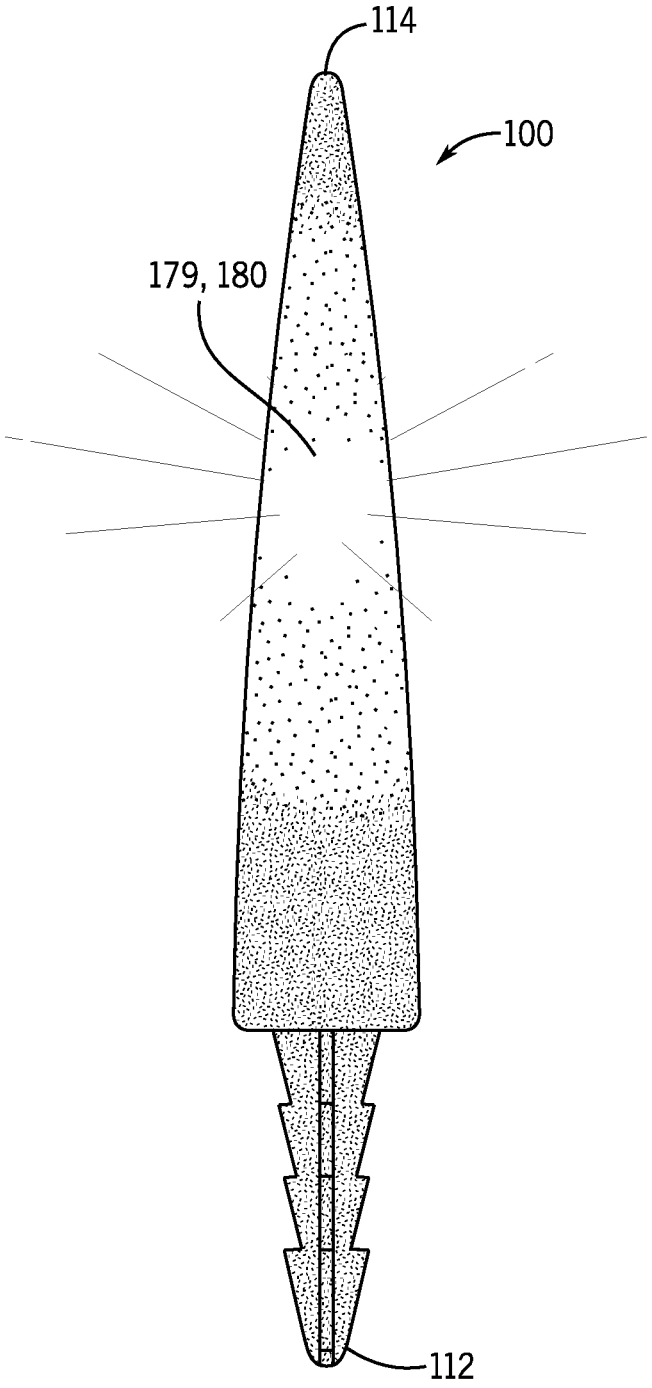
FIG. 3 is an elevation view of one or more examples of a self-illuminating tooth showing the light and tooth illuminated.

Referring to FIG. 3, tooth portion 110 and/or tooth 100 is preferably sufficiently transparent to emit light or glow. To this end, tooth portion 110 is made of a transparent or semi-transparent material which allows light or a portion thereof to pass there through. This enables an internal light source (e.g., 179, 180, 182), when activated and emitting light, to selectively illuminate tooth portion 110 and/or the entire tooth 100. The material forming tooth portion 110 may be colored or have a colored tint which, when illuminated, allows tooth portion 110 to project a color. In one or more examples of embodiments, tooth portion 110 and/or tooth 100 may be formed of a colorless material and internal light source may be colored to enable at least tooth portion 110 to appear as one or more colors. As illustrated in FIGS. 1-7, tooth portion 110 and retention portion 150 may be unitarily formed of the same material.

According to one or more examples of embodiments, a chemiluminescent device 179 (FIGS. 1-2) may be used for a light source. In this example of embodiments, the chemiluminescent tooth insert or light source 179 may be a plastic or similar container shaped to fit within the recess or access opening of the tooth and containing one or more inner breakable containers, such as a glass vial or the like, inside of it. The container and/or an inner breakable container 181 carries within it one or more chemicals or separate inner breakable containers carry separate chemicals. In the alternative, a chemical is carried in the interior of the plastic chemiluminescent tooth insert or light source 179 container surrounding the inner breakable container 181. A fluorescent dye may also be employed within the container. To activate the chemiluminescent tooth insert or light source 179, the breakable container(s) is broken, allowing the chemicals and/or dye inside the respective containers to mix. Once these substances contact each other a reaction takes place which releases light causing the light source to glow. Various commercial chemiluminescent chemical combinations and reactions are known and any such combination may be employed by the light source provided herein.

Referring to FIG. 9, one or more alternative examples of a light assembly 180 carried within cavity 130 are provided and include a light source or lamp or internal light 182. A power source or battery or batteries 184 is coupled to lamp 182 to selectively provide power thereto. In addition, a switch assembly 186 is coupled to power source 184. Switch assembly 186 includes a power switch 188, illustrated as a depressible button 188 in FIGS. 4-9. Light source 182 may be any suitable light source or light bulb, including, but not limited to, a light emitting diode (LED). Power source 184 may be any suitable battery or plurality of batteries, including, but not limited to, one or more AA battery, AAA battery, A76 battery, or any other battery, batteries, or power source suitable to selectively power lamp 182. Switch assembly 186 may be any suitable assembly for selectively activating and deactivating the flow of power from the associated power source 184 to lamp 182.

Figure 4:
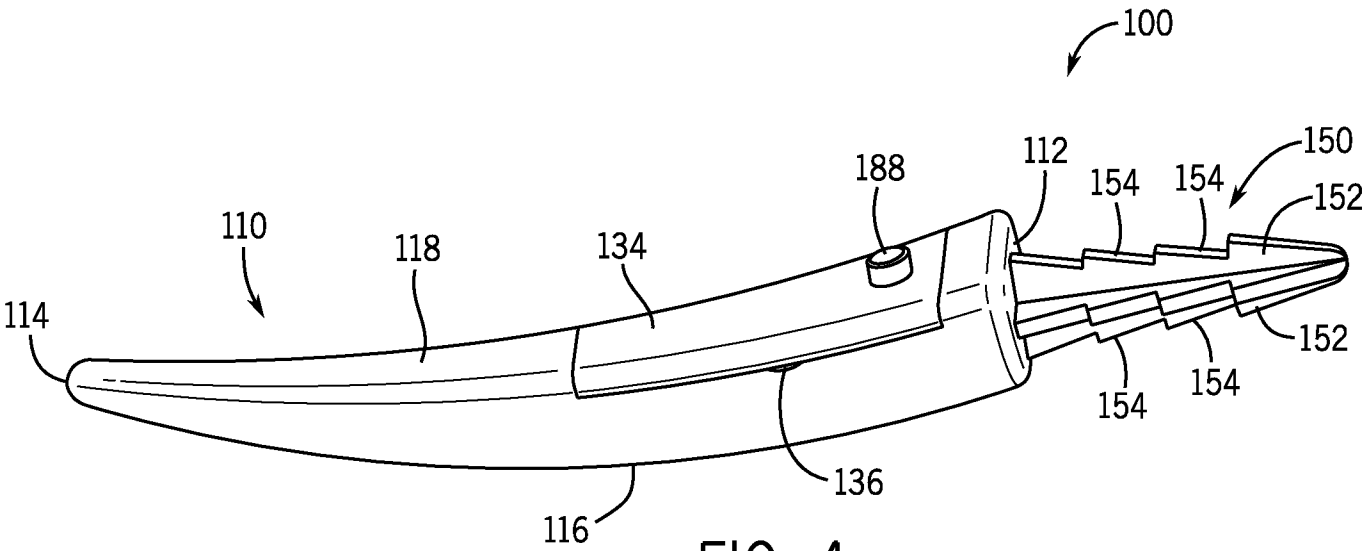
FIG. 4 is an isometric view of one or more alternative examples of embodiments of a self-illuminating tooth for a vegetable lantern.

In the example shown in FIG. 9, access to cavity 130 is preferably through the back 118 of tooth portion 110. More specifically, in the embodiments illustrated in FIGS. 3-8 cavity 130 is covered by a removable cap or lid 134 coupled to the back 118 of tooth portion 110. Cap 134 may be removably coupled to tooth portion 110 in any suitable manner, for example by a detent or by interlocking with a portion of tooth portion 110. As illustrated, tooth portion 110 may include one or more slots or grooves 136 to assist in the removal of cap 134 from tooth portion 110. As illustrated, slots 136 may be an area of the back 118 of tooth portion 110 provided around the perimeter of cap 134 and having a lower profile than the remaining area. This is to allow a user to place a portion of a finger or finger nail between cap 134 and tooth portion 110, enabling the user to generate sufficient leverage to separate cap 134 from tooth portion 110. When coupled to tooth portion 110, cap 134 may be removed to provide access cavity 130. A user may desire to access cavity 130 in order to make repairs to the enclosed light assembly 180, for example, but not limited to, replacing light source 182 or battery/batteries 184. Referring to FIGS. 4 and 9, a hole or aperture 138 is provided through cap 134. Hole 138 is adapted to receive button 188, such that button 188 passes through cap 134. This enables a user to depress button 188 to activate the light assembly 180 and associated lamp 182, illuminating tooth 100.

Figure 12:
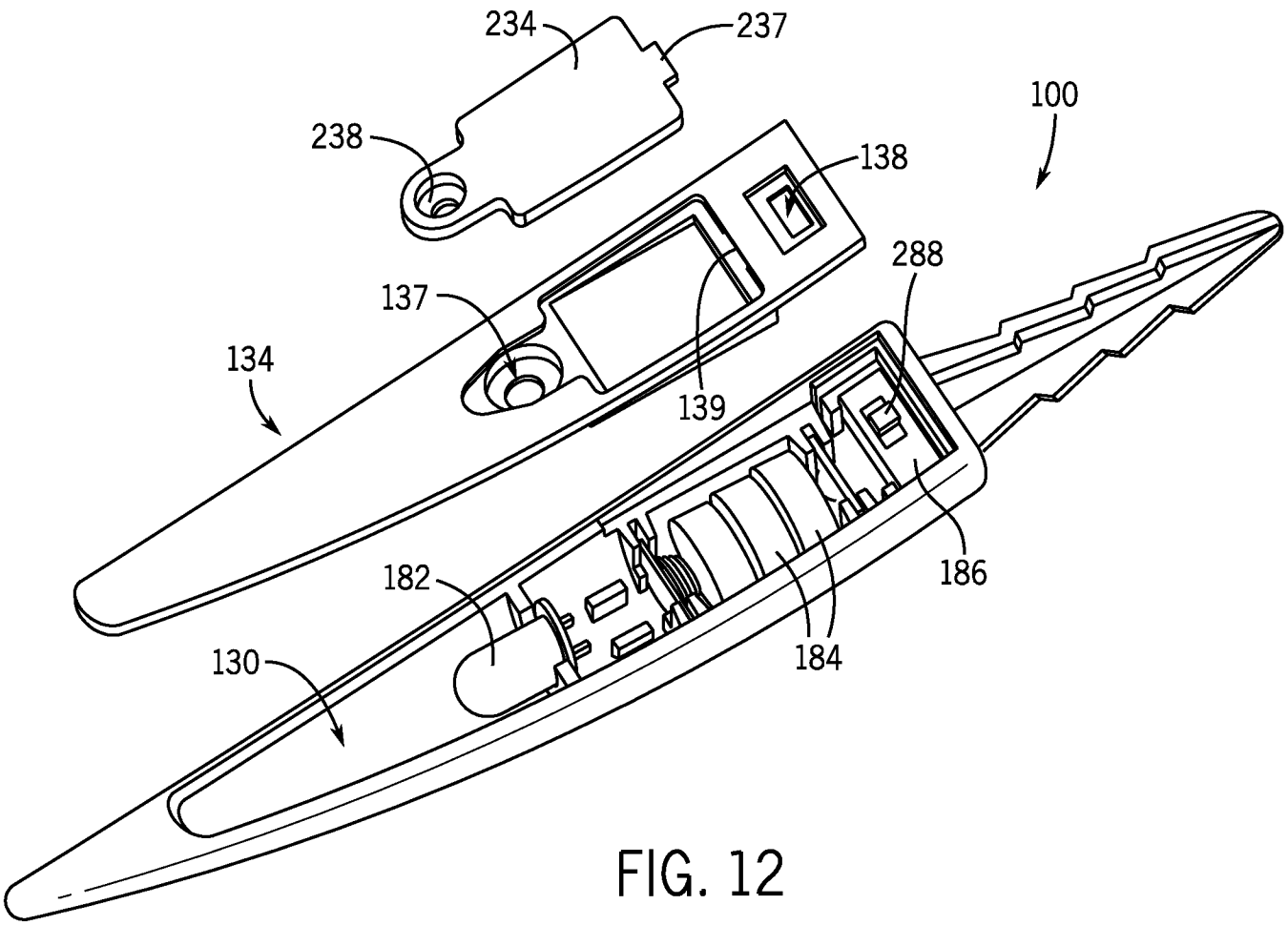
FIG. 12 is a partially exploded view of the self-illuminating tooth of FIG. 10 illustrating a protective cap being removed and an enclosed illumination assembly provided within the tooth.
Figure 13:
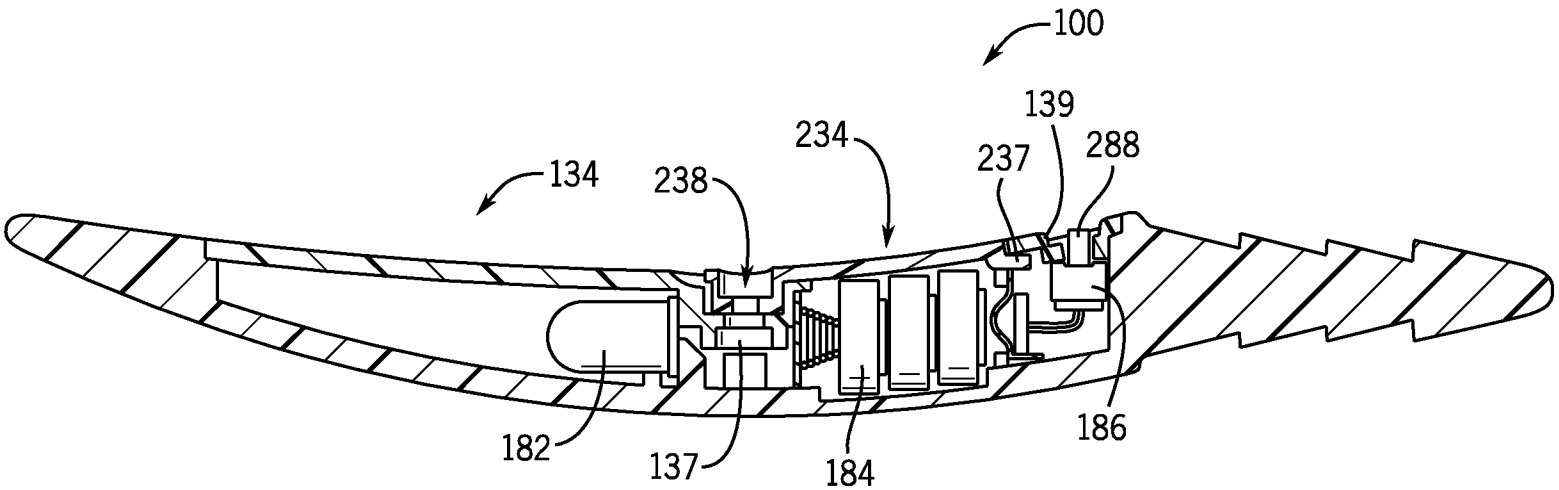
FIG. 13 is a cross-sectional view of the self-illuminating tooth of FIG. 10 taken along line 13-13 of FIG. 10.

FIGS. 10-13 illustrate an alternative embodiment of a lighted tooth 100 for use in a pumpkin. Particular components described herein are substantially the same and like numbers have been used to illustrate the like components. Referring to FIGS. 10-13, lighted tooth 100 is substantially the same as lighted tooth 100 shown in FIGS. 4-9. Lighted tooth 100 includes a switch assembly 186 which has a power switch 288. Power switch 288 is illustrated as a slidable switch which may be manually actuated between an "on" position and an "off" position. In addition, removable lid 134 includes an additional secondary cap 234. Secondary cap 234 removably engages lid 134 and provides access to replace one or more batteries of power source 184. As illustrated in FIGS. 12-13, secondary cap 234 may include a tab 237 which may be received in a corresponding slot 139 provided in lid 134. Secondary cap 234 may also include a secondary aperture 238, which may be received in a corresponding aperture 137 provided in lid 134. The secondary aperture 238 and corresponding aperture 137 may together receive a single connecting member 240 (FIG. 11), for example a screw. The combination of tab 237 and connecting member 240 enables the secondary cap 234 to be removably connected to lid 134 and the associated tooth 200.

In one or more examples of embodiments, a pumpkin kit or a kit for decorating a vegetable lantern may be provided. Various examples of packaged and assembled kits are shown in FIGS. 14-21. The pumpkin kit may include one or more components in a package. A kit as described and illustrated herein may include, for example, materials to decorate one or more pumpkins. To this end, the kit may include pumpkin carving tools. The kit may also include one or more pumpkin teeth. The pumpkin kit may also include a foam pumpkin. One or more lights may be provided for placement in the carved pumpkin. Paint or other coloring elements may be provided for use on the pumpkin. An anti-theft or theft deterrent device for the pumpkin may also be provided in the kit. While specific examples are provided, any number and arrangement of components would be acceptable for the purposes of the present invention.

As described herein, pumpkin carving tools may be included in the kit. Examples of carving tools include, but are not limited to, a carving knife or pumpkin carving knife, saw, blade, scoop, mallet, poker, drills, scoring tool, and/or pumpkin coring or gutting tools, as well as stencils or patterns for use in creating the pumpkin design.

Figure 14:
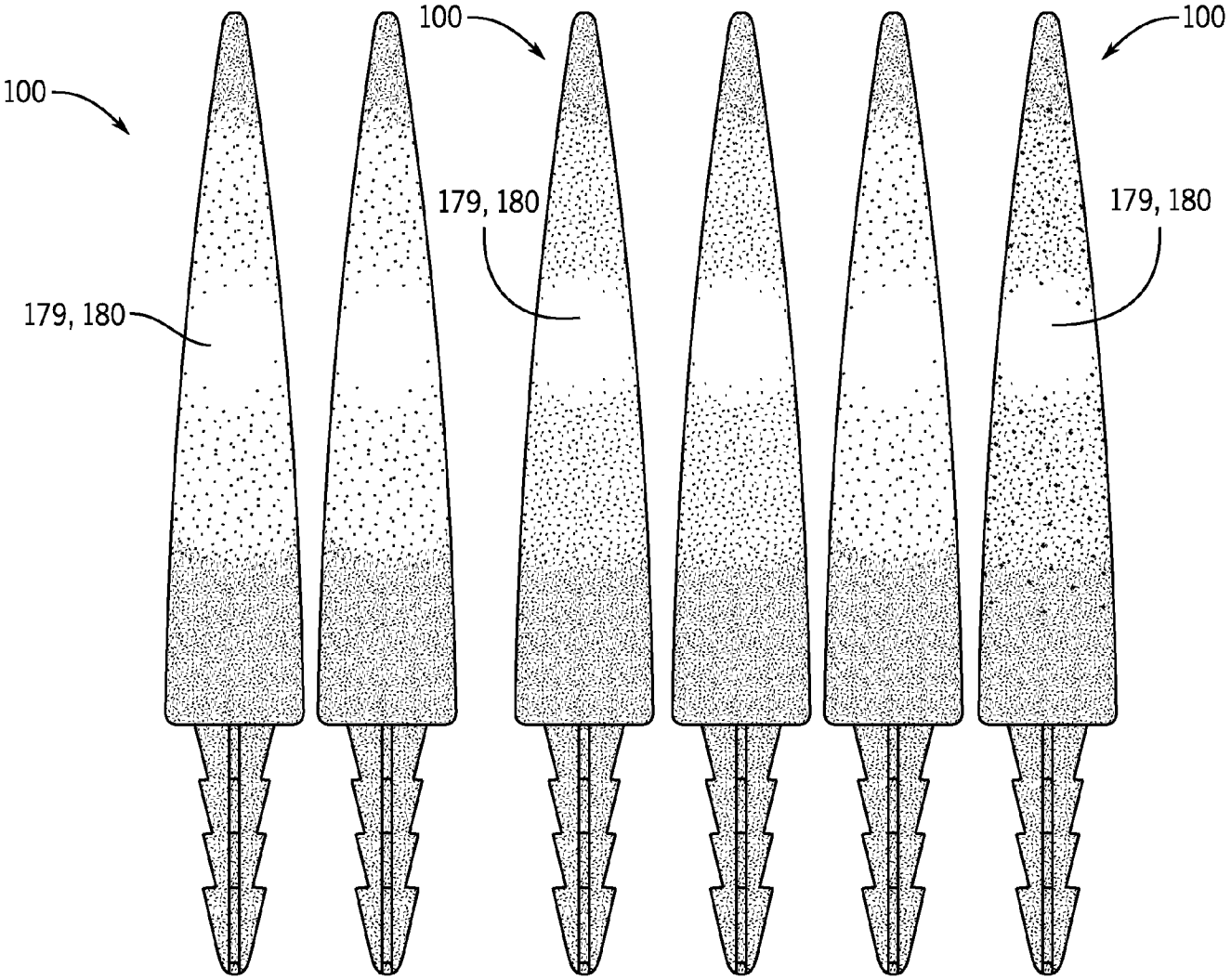
FIG. 14 is an elevation view of a plurality of self-illuminating teeth for use in a kit according to one or more examples of embodiments, showing the teeth lit with varying colors.
Figure 15:
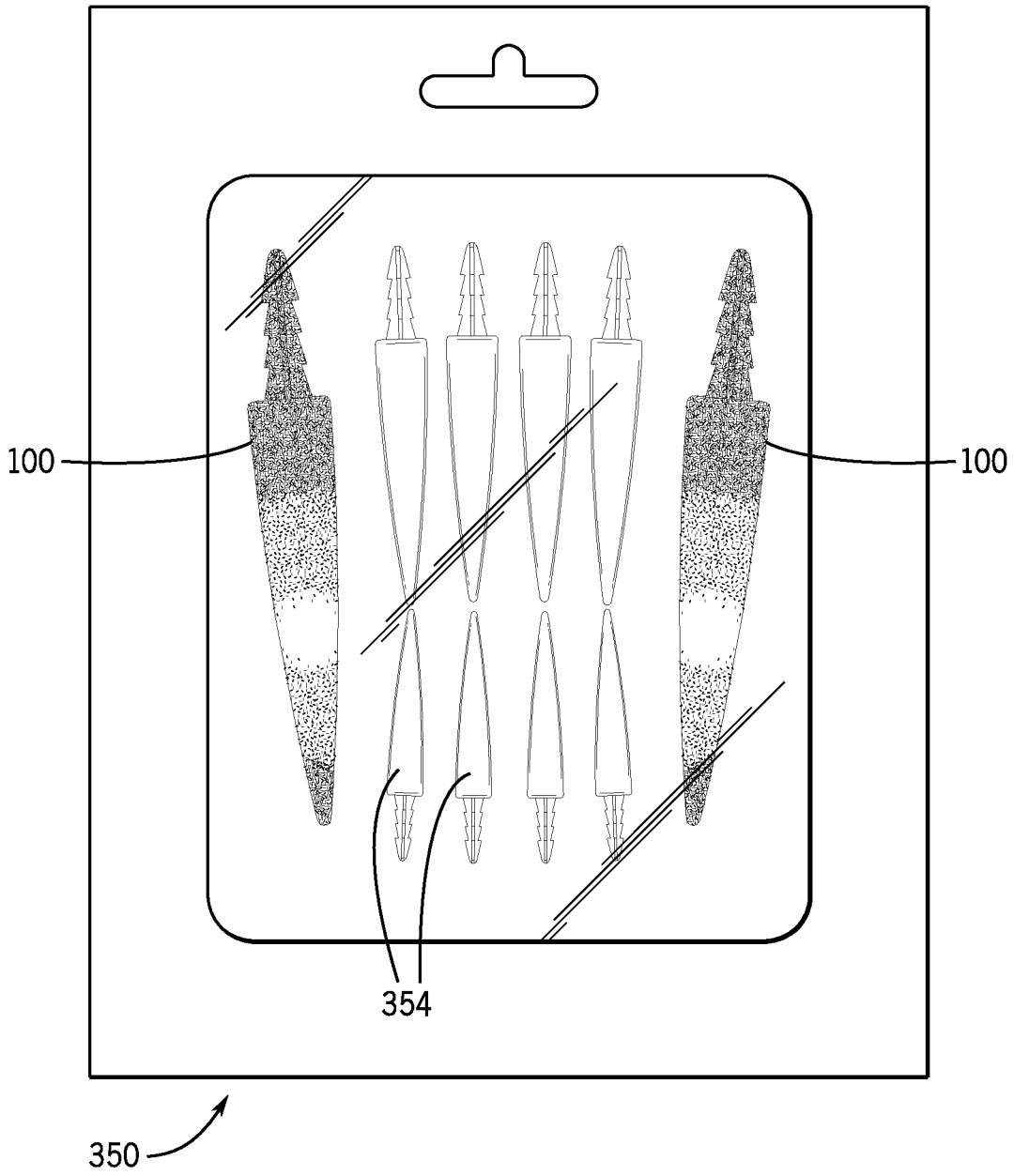
FIG. 15 illustrates one or more examples of a kit including a package containing a plurality of self-illuminating teeth and non-illuminating teeth.
Figure 16:
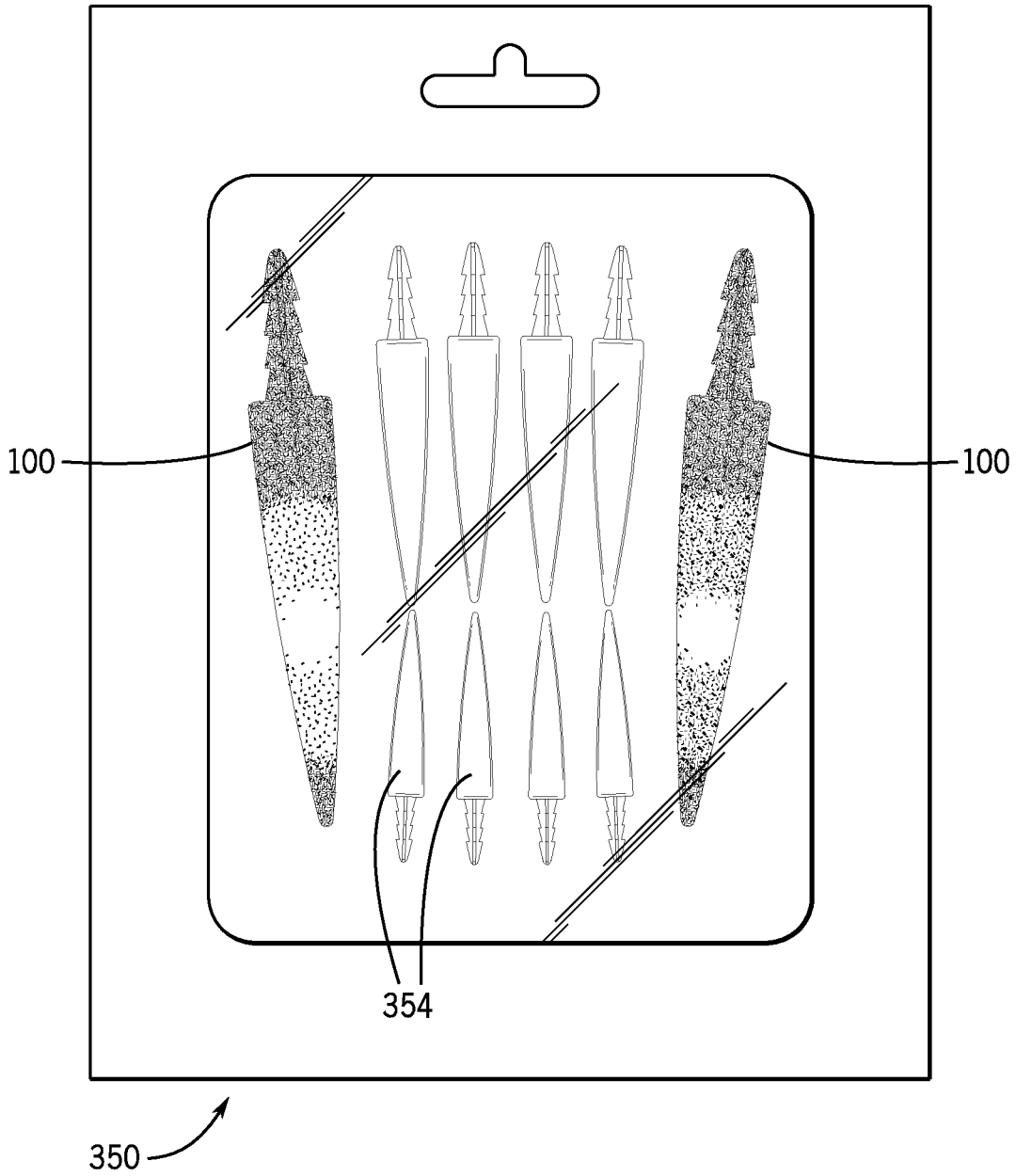
FIG. 16 illustrates one or more examples of a kit including a package containing a plurality of self-illuminating teeth of varying colors and non-illuminating teeth.
Figure 17:
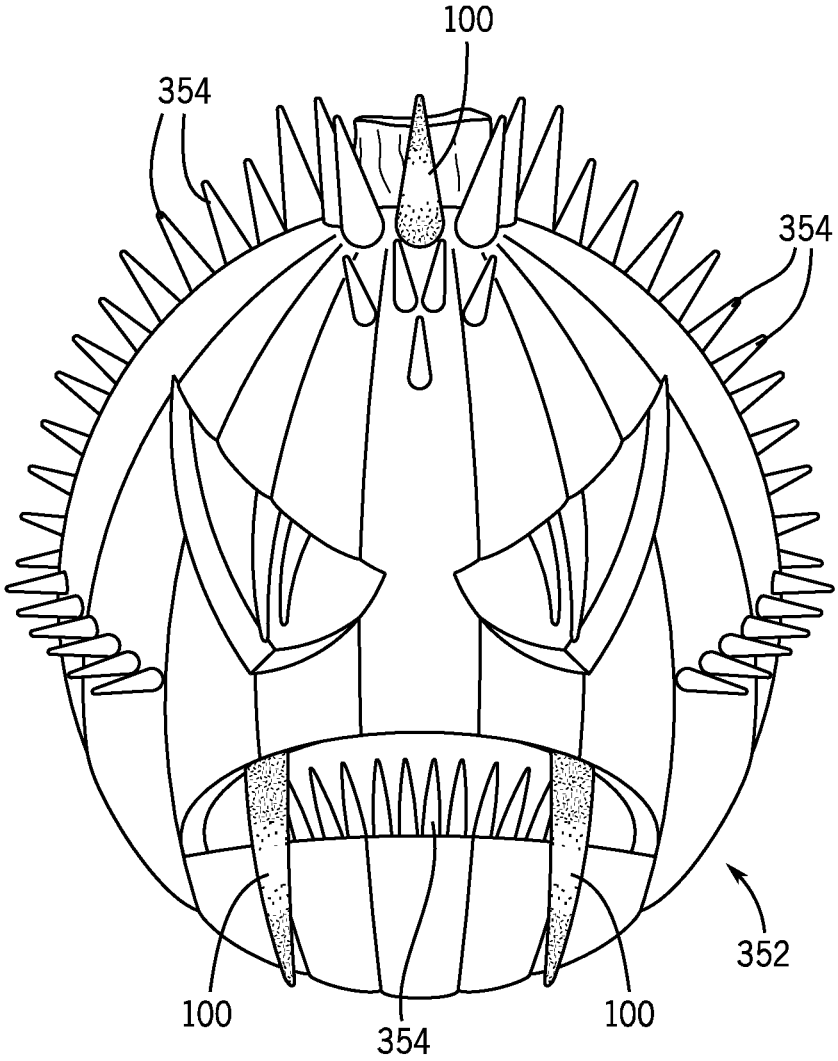
FIG. 17 is a perspective view of a vegetable lantern having a plurality of self-illuminating teeth and non-illuminating teeth thereon.

According to one or more examples of embodiments, a plurality of pumpkin teeth 100 may be provided for the kit (FIG. 14). For example, as shown in FIGS. 15-16 a package containing multiple teeth 100 (one or more of which may be self-illuminating teeth) or more than one package containing multiple teeth 100 (which teeth may be of one shape or size or type, or more than one shape or size or type) may be provided in the kit. Accordingly, the kit may include one or more self-illuminating teeth 100 as described herein, as well as one or more lights or light sources 179, 180, 182 for said teeth. Preferably, a plurality of teeth 100 are included in the kit. In one or more examples of embodiments, one or more self-illuminating teeth 100, which may be provided in a kit, are used to decorate a vegetable lantern. An example of same is shown in FIG. 17, showing a plurality of self-illuminating teeth 100 inserted into a pumpkin 352 both in the location of traditional teeth (e.g., in a mouth), and as additional or alternative decorative features. The self-illuminating teeth 100 may further be provided in association with similar teeth which do not illuminate, e.g., teeth 354 in FIG. 17.

Figure 18:
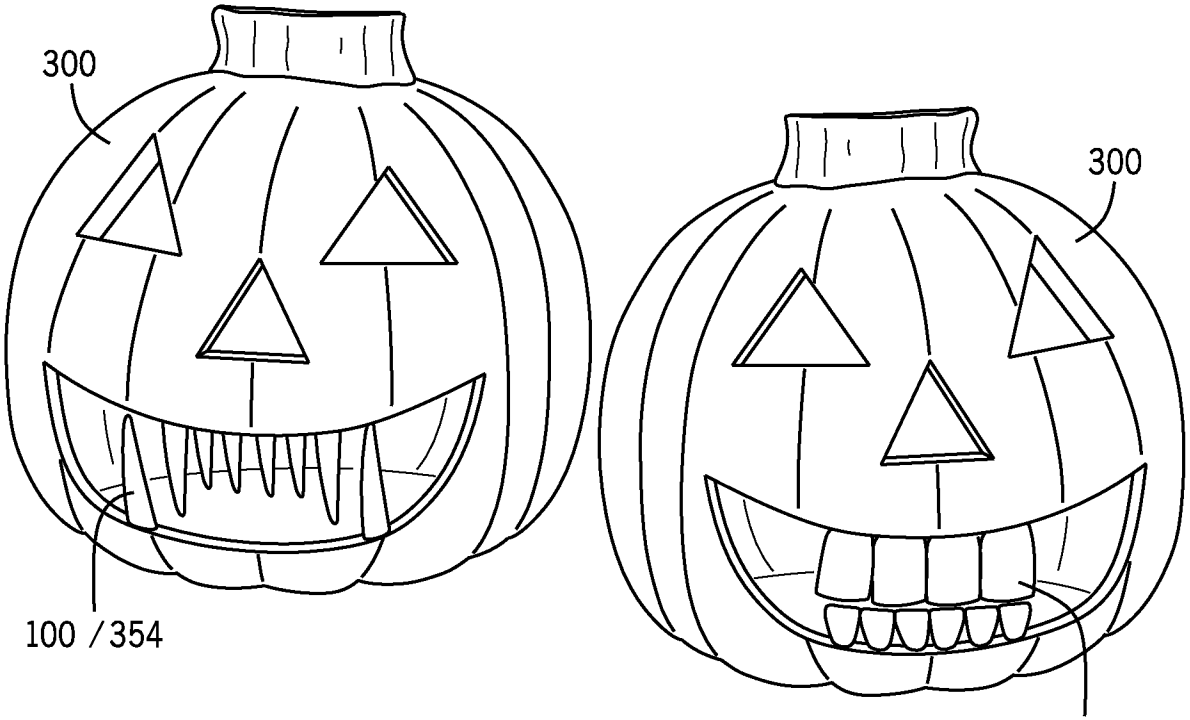
FIG. 18 illustrates one or more examples of an assembled kit for a vegetable lantern.

In one or more examples of embodiments, a foam pumpkin 300 or vegetable lantern may be provided in the kit (See FIG. 18). The foam pumpkin 300 may be used in place of a real pumpkin/vegetable lantern or may be provided as a practice pumpkin to provide practice using the tools set forth in the kit. The foam may be a solid foam, such as a closed-cell foam (e.g., gas forms discrete pockets, each completely surrounded by the solid material), or an open-cell foam (e.g., the gas pockets connect with each other, and water can easily flow through the entire structure, displacing the air). While foam is specifically described, the material may be any material which has a degree of rigidity and elasticity to permit cutting with one or more carving tools and to permit insertion and retention of a pumpkin tooth 100 in the material. In one example, the foam pumpkin 300 may be formed of a skin of a first material and an interior of a different material or a different density material. The foam pumpkin 300 may also optionally be provided pre-cut with a predetermined design.

Figure 19:
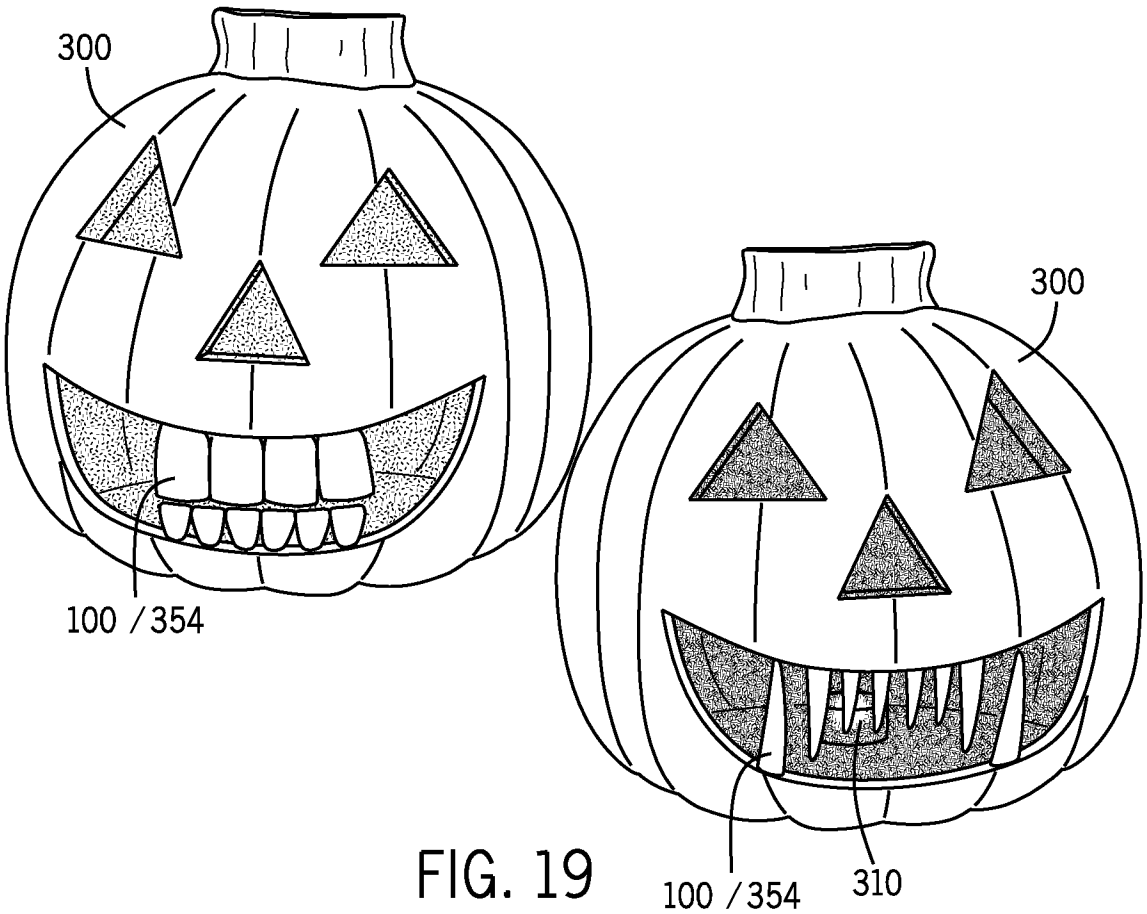
FIGS. 19-21 illustrate one or more examples of an assembled kit as shown in FIG. 18, showing different lantern illuminations.
Figure 20:
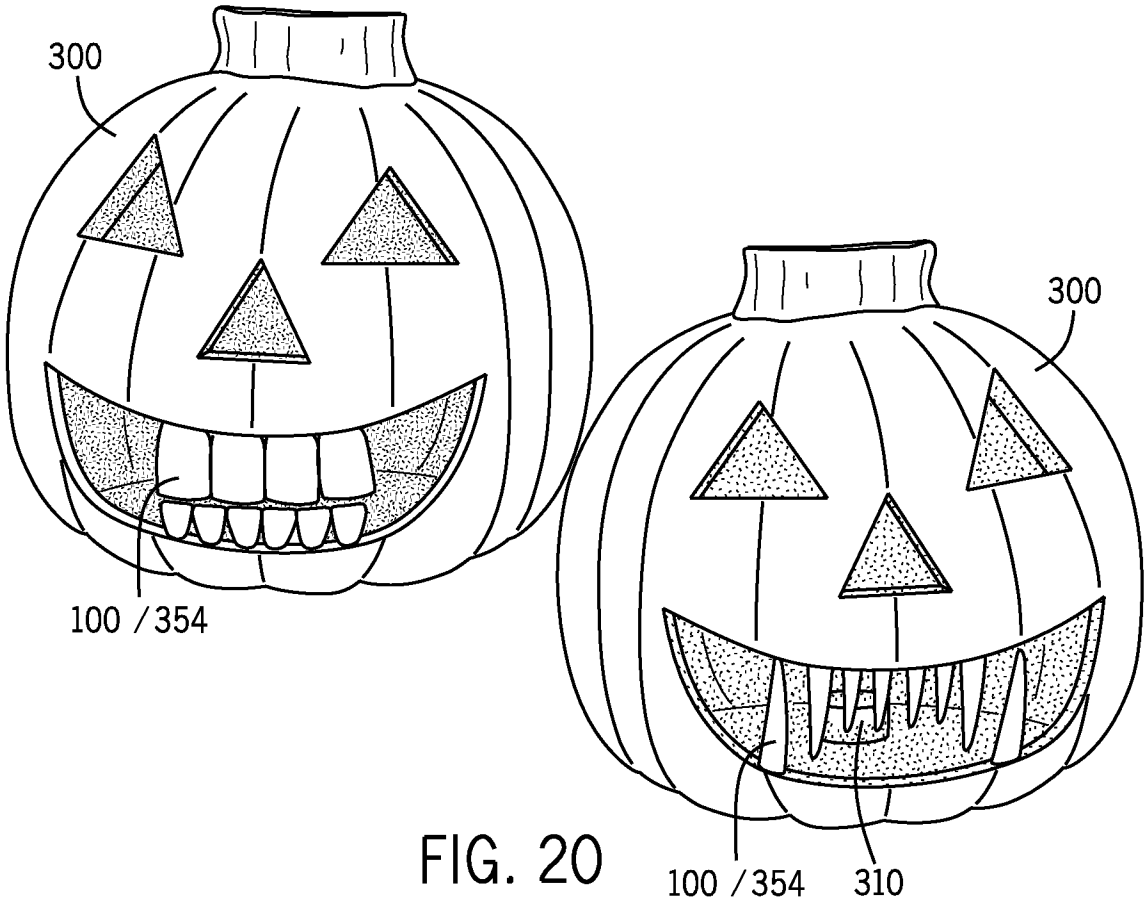
Figure 21:
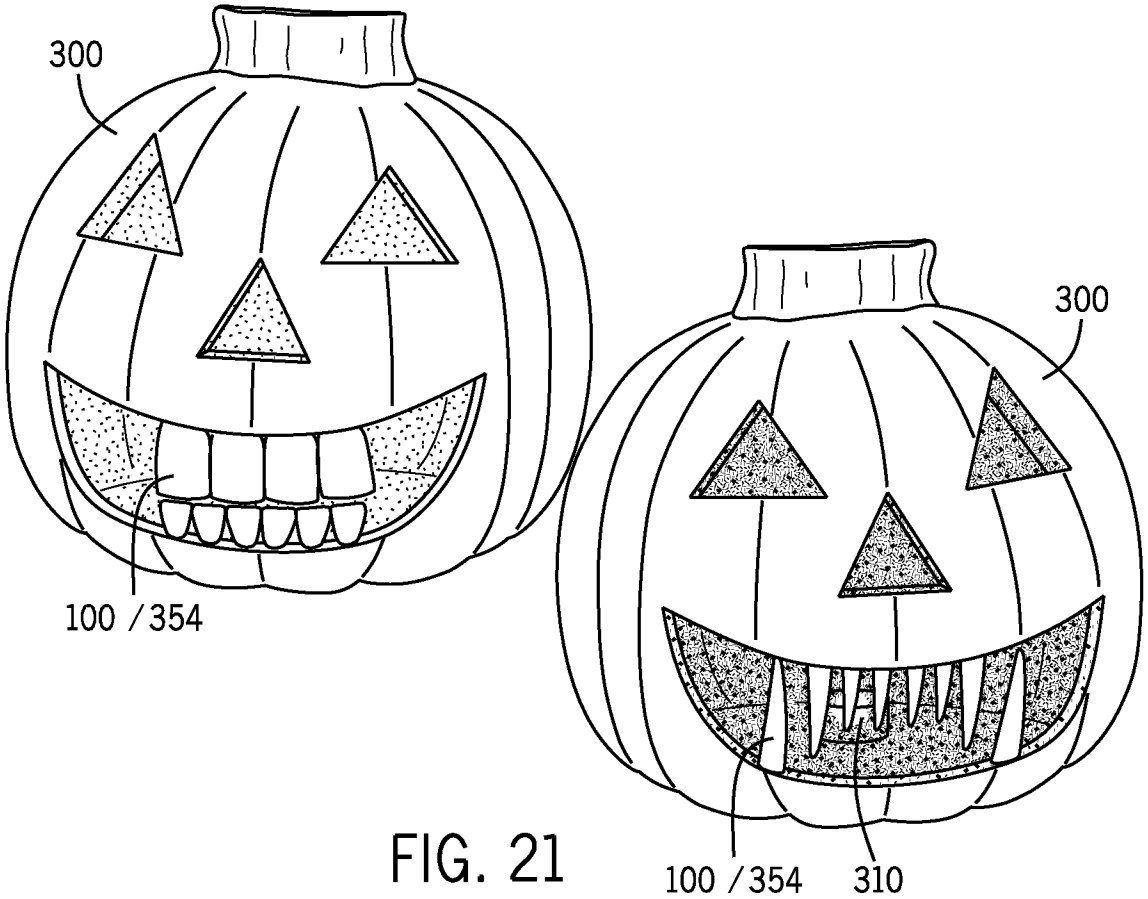

In one or more examples of embodiments, one or more lights 310 or light sources may be provided in the kit for lighting the interior of a pumpkin (See FIGS. 19-21). In one example of embodiments, the light 310 is or includes one or more LED lights which are powered by a battery or other power source. The light 310 may be a single color, or may be more than one color. For example, a light 310 may change color, or may be changeable by the user (compare FIGS. 19-21). In one or more further examples of embodiments, the light 310 may be defined by, or an additional light may be provided in the kit, which includes a strobe light or other blinking or flashing or trailing light, and to this end may be a continuous light or a non-continuous light. In one or more further examples of embodiments, the light 310 may be, or the kit may include, a black light. The light 310 or light source may also include one or more switches for operation (e.g., on/off, color change, continuous/non-continuous) of the light.

The kit may also include one or more materials to decorate a surface of a pumpkin. Examples include, but are not limited to, paint, stickers, crayons, and corresponding tools for applying such materials. For instance, a fluorescent paint and brush to apply the paint may be provided in a kit.

In one or more examples of embodiments, the kit may include an anti-theft or theft deterrent system. To this end, a pressure sensitive device may be provided which alerts others to the movement of a pumpkin. In one or more examples of embodiments, the pressure sensitive device may be, or include, an exploding dye pack/non-toxic paint pack which is placed under a decorated pumpkin. As an illustrative example, when the pumpkin is moved, such as by a vandal, the dye pack or paint is blown or spayed onto the vandal, marking the individual who moved the pumpkin. The paint or dye pack may be any suitable color, but is preferably a bright color such that it is visible to others. In one or more alternative examples of embodiments, a pressure sensitive disc is provided beneath the carved pumpkin or a portion thereof and is coupled to a marking device, such as a dye or paint application device. In the alternative, or in combination with such a marking device, a noise making device may be coupled to the anti-theft device to alert others to tampering with the pumpkin.

The kit described herein may be formed to include one or more of each of the foregoing components. In this regard, the kit may be formed of a plurality of tools for decorating a pumpkin. In examples of embodiments, the kit may be formed for a targeted user. For instance, a child friendly kit may be formed which includes, for example, buck teeth (which may be self-illuminating teeth), fluorescent paint, stickers, lights, etc., as well as non-sharp carving tools, which kit contents are considered child friendly.

In operation and use of lighted tooth 100 a user may selectively insert the tooth 100 into a decorative lantern, such as a pumpkin, or for example a practice pumpkin 300 as described herein. More specifically, a user may insert tooth retention portion 150 into the membrane of a pumpkin which is between the skin and the hollow inside portion. A user may optionally first carve a design into the pumpkin membrane, such as for example, an area which corresponds to a mouth.

Before or after the tooth 100 is inserted into a pumpkin, the user may activate the internal light so as to activate the self-illuminating tooth 100. For example, a chemiluminescent tooth insert 179 may be activated by, for example, cracking the breakable container 181, or otherwise causing the chemicals to mix and emit light. The tooth insert 179 may then be inserted into the cavity 130. In one or more examples of embodiments, the light source 179 is inserted by pressing down into or through the blister-seal 131, snapping or fixing the light source in place in the tooth cavity 130. In the alternative, the light source 179 is inserted into an open cavity 130 in the tooth. In one more alternative embodiments, the insert 179 may be provided pre-installed in the tooth or tooth cavity 130, or may be inserted before activation into said cavity. In this regard, the chemiluminescent tooth insert or light source 179 may be activated in place in the tooth. While a single light source, cavity and corresponding components are described for ease of reference, multiple such devices may be used in the same fashion. In one or more alternative examples of embodiments, the light source 180, 182 may be activated by actuating power switch 188, 288 to an "on" position such that power from power source 184 flows to light 182, activating light 182.

Once light 179, 182 is activated, tooth 100 will be illuminated or with light up. A user may then keep tooth 100 illuminated until a later desired time. At that later desired time, the user may desire to switch off or turn off tooth 100, or may remove the light source (e.g., removing light source 179 from cavity 130). A user may deactivate light 182 by actuating power switch 188, 288 to an "off" position such that power from power source 184 ceases to flow to light 182, or remove the light source (e.g., 179) altogether. The tooth 100 can be re-lit by inserting the same or a new light source 179, or actuating the power switch 188, 288.

Accordingly, the self-illuminating tooth and kit for decorating a vegetable lantern provided herein provide various advantages. The self-illuminating tooth and kit provide a reusable, low cost, and easy to use device for decorating a vegetable lantern with many of the tools and decorations necessary to do so in a unique way. Not only may the self-illuminating tooth or plurality of such teeth be reused, but the tooth can be used or reused to provide different effects, such as by substitution or use of multiple different light colors, or without light, in a variety of combinations. Likewise, the kit is reusable and may be provided in a variety of combinations to decorate a vegetable lantern in a new way each use. The self-illuminating tooth and kit provide further advantages in that they eliminate the need for an open flame within the lantern reducing or eliminating safety and/or fire concerns.

As utilized herein, the terms "approximately," "about," "substantially", and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the invention as recited in the appended claims.

It should be noted that references to relative positions (e.g., "top" and "bottom") in this description are merely used to identify various elements as are oriented in the Figures. It should be recognized that the orientation of particular components may vary greatly depending on the application in which they are used.

For the purpose of this disclosure, the term "coupled" means the joining of two members directly or indirectly to one another. Such joining may be stationary in nature or moveable in nature. Such joining may be achieved with the two members or the two members and any additional intermediate members being integrally formed as a single unitary body with one another or with the two members or the two members and any additional intermediate members being attached to one another. Such joining may be permanent in nature or may be removable or releasable in nature.

It is also important to note that the construction and arrangement of the system, methods, and devices as shown in the various examples of embodiments is illustrative only. Although only a few embodiments have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements show as multiple parts may be integrally formed, the operation of the interfaces may be reversed or otherwise varied, the length or width of the structures and/or members or connector or other elements of the system may be varied, the nature or number of adjustment positions provided between the elements may be varied (e.g. by variations in the number of engagement slots or size of the engagement slots or type of engagement). The order or sequence of any process or method steps may be varied or re-sequenced according to alternative embodiments. Other substitutions, modifications, changes and omissions may be made in the design, operating conditions and arrangement of the various examples of embodiments without departing from the spirit or scope of the present inventions.

While this invention has been described in conjunction with the examples of embodiments outlined above, various alternatives, modifications, variations, improvements and/or substantial equivalents, whether known or that are or may be presently foreseen, may become apparent to those having at least ordinary skill in the art. Accordingly, the examples of embodiments of the invention, as set forth above, are intended to be illustrative, not limiting. Various changes may be made without departing from the spirit or scope of the invention. Therefore, the invention is intended to embrace all known or earlier developed alternatives, modifications, variations, improvements and/or substantial equivalents.

The technical effects and technical problems in the specification are exemplary and are not limiting. It should be noted that the embodiments described in the specification may have other technical effects and can solve other technical problems.

The invention claimed is:

1. A self-illuminating tooth for a vegetable lantern comprising:

a tooth portion having a front facing portion, a rear facing portion, and a cavity provided within the tooth portion provided on the rear facing portion;

a tooth retention portion coupled to the tooth portion and having a plurality of flights, each flight having a serrated edge;

a light provided within the cavity of the tooth portion, the light comprising a chemiluminescent tooth insert, wherein the light is replaceable within the cavity and may be selectively actuated to illuminate the tooth portion by actuation of the light.

2. The self-illuminating tooth of claim 1, wherein the light is actuatable prior to insertion in the access passage.

3. The self-illuminating tooth of claim 1, further comprising a blister-seal covering the cavity.

4. The self-illuminating tooth of claim 1, wherein the light is press-fit within the cavity.

5. The self-illuminating tooth of claim 1, wherein the light is removably received within the cavity.

6. The self-illuminating tooth of claim 1, wherein the light is colored.

7. The self-illuminating tooth of claim 1, wherein the tooth portion is sufficiently transparent to emit light.

8. The self-illuminating tooth of claim 1, wherein the vegetable lantern is made of a synthetic material.

9. A vegetable lantern decorating kit comprising the self-illuminating tooth of claim 1.

10. A vegetable lantern decorating kit comprising a plurality of self-illuminating teeth as recited in claim 1.

11. A self-illuminating tooth for a vegetable lantern comprising:

a tooth portion having a front facing portion, a rear facing portion, and a cavity provided within the tooth portion provided on the rear facing portion;

a tooth retention portion coupled to the tooth portion and having a plurality of flights, each flight having a serrated edge;

a light assembly provided within the cavity of the tooth portion, the light assembly having a light, a power source, and a switch assembly, wherein the light assembly may be selectively actuated to illuminate the tooth portion by actuation of the switch assembly.

12. The self-illuminating tooth of claim 11, wherein the light is colored.

13. The self-illuminating tooth of claim 11, wherein the tooth portion is sufficiently transparent to emit light.

14. The self-illuminating tooth of claim 11, wherein the vegetable lantern is made of a synthetic material.

15. The self-illuminating tooth of claim 11, wherein the switch assembly includes a slidable switch which extends from the cavity through rear facing portion of the tooth portion.

16. The self-illuminating tooth of claim 11, wherein the switch assembly includes a depressible switch which extends from the cavity through rear facing portion of the tooth portion.

17. A vegetable lantern decorating kit comprising the self-illuminating tooth of claim 11.

18. A vegetable lantern decorating kit comprising a plurality of self-illuminating teeth as recited in claim 11.

19. A method of decorating a pumpkin comprising:

inserting a tooth retention portion of a self-illuminating tooth into an outer membrane of a pumpkin; and activating a light source for the self-illuminating tooth such that a light within the self-illuminating tooth illuminates the tooth.

20. The method of decorating a pumpkin of claim 19, wherein the self-illuminating tooth is obtained from a kit comprising a plurality of tools for decorating a pumpkin.

* * * * *